US011459834B2

(12) United States Patent
Kirk et al.

(10) Patent No.: US 11,459,834 B2
(45) Date of Patent: Oct. 4, 2022

(54) DOWNHOLE APPARATUS AND ASSOCIATED METHODS

(71) Applicant: Vulcan Completion Products UK Limited, Aberdeenshire (GB)

(72) Inventors: Ian Kirk, Aberdeenshire (GB); Nathan Kirk, Aberdeenshire (GB)

(73) Assignee: VULCAN COMPLETION PRODUCTS UK LIMITED, Aberdeen (GB)

( * ) Notice: Subject to any disclaimer, the term of this patent is extended or adjusted under 35 U.S.C. 154(b) by 5 days.

(21) Appl. No.: 16/620,213

(22) PCT Filed: Jun. 6, 2018

(86) PCT No.: PCT/GB2018/051542

§ 371 (c)(1),
(2) Date: Dec. 6, 2019

(87) PCT Pub. No.: WO2018/224825

PCT Pub. Date: Dec. 13, 2018

(65) Prior Publication Data

US 2020/0408050 A1 Dec. 31, 2020

(30) Foreign Application Priority Data

Jun. 7, 2017 (GB) ..... 1709039

(51) Int. Cl.
*E21B 17/10* (2006.01)

(52) U.S. Cl.
CPC ..... *E21B 17/1028* (2013.01); *E21B 17/1078* (2013.01)

(58) Field of Classification Search
CPC ..... E21B 17/1021; E21B 17/1028; E21B 17/1078; E21B 17/1057; E21B 17/10; E21B 19/24
See application file for complete search history.

(56) References Cited

U.S. PATENT DOCUMENTS 3,124,196 A 3/1964 Solum
3,343,608 A 9/1967 Solum
(Continued)

FOREIGN PATENT DOCUMENTS

CN 206071481 U 4/2017
EP 0297716 A1 5/1988
(Continued)

OTHER PUBLICATIONS

International Search Report and Written Opinion dated Oct. 29, 2018 for corresponding International Patent Application No. PCT/GB2018/051542.

(Continued)

*Primary Examiner* — David Carroll
(74) *Attorney, Agent, or Firm* — Tarolli, Sundheim, Covell & Tummino LLP

(57) ABSTRACT

A centraliser includes a number of members extending between two collars for mounting the centraliser on a casing. The members are configured to contact a wall of the bore and centraliser the casing in the bore. The members are radially moveable between the casing and the bore wall. The members further include an intermediate portion and end portions, the end portions being relatively more flexible than the intermediate portion.

23 Claims, 7 Drawing Sheets

(56) References Cited

U.S. PATENT DOCUMENTS

| | | | | | |
|---|---|---|---|---|---|
| 4,787,458 | A * | 11/1988 | Langer | E21B 17/1028 | 166/380 |
| 5,097,905 | A | 3/1992 | Goodwin | | |
| 5,785,125 | A * | 7/1998 | Royer | E21B 17/1021 | 166/241.1 |
| 9,771,763 | B2 * | 9/2017 | McDaniel | E21B 17/1078 | |
| D873,867 | S * | 1/2020 | Neel | D15/21 | |
| 10,988,991 | B1 * | 4/2021 | McCormick | E21B 17/1021 | |
| 2003/0000607 | A1 * | 1/2003 | Jenner | E21B 17/1028 | 148/652 |
| 2011/0079385 | A1 | 4/2011 | Linaker | | |
| 2015/0034336 | A1 * | 2/2015 | Morrison | E21B 17/1014 | 166/381 |
| 2017/0260816 | A1 * | 9/2017 | Martin | E21B 17/1014 | |

FOREIGN PATENT DOCUMENTS

| | | | |
|---|---|---|---|
| WO | 9853178 | A1 | 11/1998 |
| WO | 2016030689 | A1 | 3/2016 |

OTHER PUBLICATIONS

GB Search Report dated Oct. 20, 2017 for corresponding GB Application No. 1709039.0.

* cited by examiner

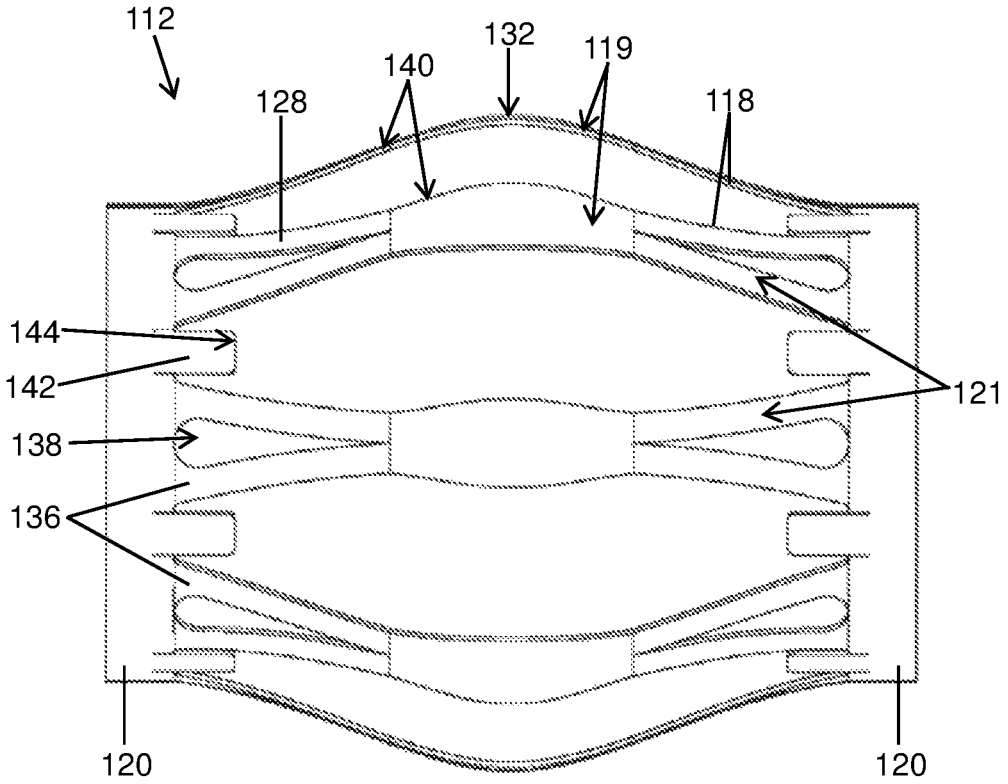
Figure 3
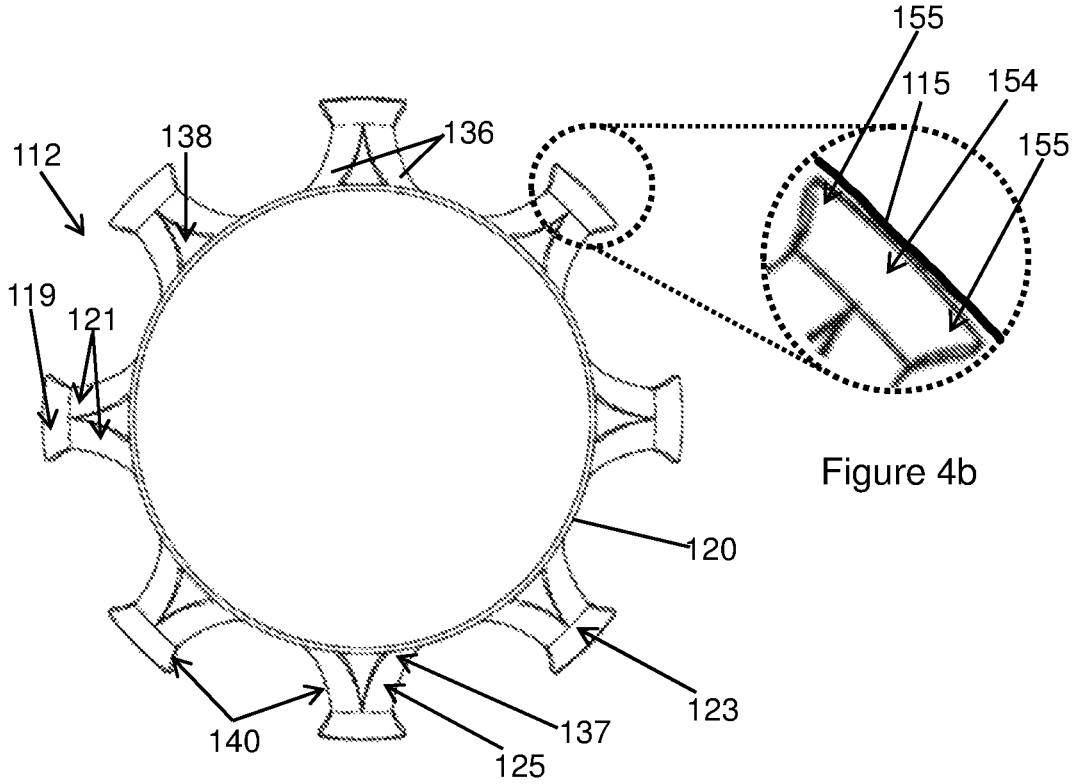
Figure 4b
Figure 4a

DOWNHOLE APPARATUS AND ASSOCIATED METHODS

RELATED APPLICATIONS

The present application is a U.S. National Stage application under 35 USC 371 of PCT Application Serial No. PCT/GB2018/051542, filed on 6 Jun. 2018, which claims priority to GB Application No. 1709039.0, filed on 7 Jun. 2017; the entirety of both of which are incorporated herein by reference.

FIELD

This disclosure relates to a centraliser, for example a casing centraliser.

BACKGROUND

Boreholes drilled to access subsurface formations, for example hydrocarbon-bearing formations, are typically lined with metal tubing, sometimes known as casing or liner. The bore-lining tubing may be run into a drilled bore, leaving an annulus between the bore wall and the outer surface of the casing. A settable material such as cement may be circulated into the annulus to provide a seal between the tubing and the bore wall. It is generally desirable that the cement sheath formed around the casing is of consistent thickness, which requires that the casing be centred in the bore as the cement sets. This may be achieved by mounting centralisers on the casing, for example, at least one centraliser per tubing joint. Centralisers take many forms and may be solid or flexible, for example 'bow-spring' type centralisers feature end collars with spring bow portions extending between the collars. The spring bow portions are typically concave and describe an arc with a crest at a mid-portion between the collars. The spring bow portions may be deflected radially inwards to permit a casing string carrying such centralisers to pass through bore restrictions.

The primary roles of a centraliser are to facilitate running of the casing string to the desired depth in the bore and then to provide a sufficient force, sometimes referred to as the restoring force, to maintain the casing coaxial with the bore. For flexible or spring centralisers, maintaining the casing string coaxial with the bore becomes more challenging in deviated or horizontal bores, where the mass of the string will tend to deform the spring bow portions of the centralisers on the underside of the casing such that the string lies towards to low side of the bore. Such deformation may be reduced by increasing the stiffness of the spring bow portions, but stiffer bow spring portions make it more difficult to run the casing into the bore, in particular increasing the force required to move a centraliser into a restriction or smaller diameter section of the bore, sometimes referred to as the starting force, and then to move the centraliser through the restriction, sometimes referred to as the running force. The spring bow portions must also recover to a larger diameter configuration after passing through the restriction.

Centralisers that must be run into a bore through a restriction will sometimes initially describe a larger diameter than the bore where the casing will ultimately be located. This practice recognises that the centralisers will not recover to the initial diameter after passing through the restriction.

Examples of different forms of centralisers are described in European Patent Application publication number 0297716 and U.S. Pat. No. 6,997,254.

SUMMARY

According to an example of the present disclosure there is provided a centraliser for centralising tubing in a bore. The centraliser may comprise end collars connected by members. The members may comprise an intermediate portion. The members may comprise end portions for connecting the intermediate portion to the end collars. The centraliser may be configurable between a larger diameter configuration in which the intermediate portion assumes a radially outer position with respect to the centraliser and a smaller diameter configuration in which the intermediate portion assumes a radially inner position. The end portions may be configured to permit movement of the intermediate portion between the radially outer and inner positions. The intermediate portion may be relatively less flexible than the end portions.

In use, different parts of the centraliser may adapt to the space within the bore so as to pass through the bore or restrictions in the bore. Any part of the centraliser may be flexed, deformed, or otherwise distorted while passing through the bore and/or supporting the tubing in the bore (such as in horizontal or inclined sections of the bore). The intermediate portion may experience less flexing than the end portions. The members may define blades of the centraliser. The intermediate portion may define a paddle of the blade. At least part of the centraliser may experience a degree of deformation (e.g. plastic deformation) if passing through a restriction. The end portions and the relatively less flexible intermediate portion may reduce or limit the degree of deformation experienced by the centraliser. It will be appreciated that the term "flexing" may refer to bending, twisting, distortion, deformation, and/or any other form of movement of the intermediate portion.

The intermediate portion may comprise at least one rigid portion, may be rigid, or may be at least partially rigid. The intermediate portion may be configured to be resistant to at least one of: flexing, bending, twisting, deforming, or the like. The intermediate portion may be rigid, or configured to be resistant to flexing, bending, twisting, deforming, or the like, in any appropriate way. The intermediate portion may be relatively more stiff or rigid than the end portions.

The end portions may comprise at least one flexible portion, may be flexible, or may be at least partially flexible. The end portions may be configured to be at least one of: flexible, bendable, twistable, deformable, or the like. The end portions may be flexible, or configured to be flexible, bendable, twistable, deformable, or the like, in any appropriate way. The end portions may be relatively less stiff or rigid than the intermediate portion.

At least one feature or component, for example the intermediate portion and/or the end portions, of the centraliser may comprise a curved section. At least one of the intermediate portion and the end portions may comprise a curved section, which may be curved in any appropriate way or direction. The curved section may be defined in any direction in relation to the centraliser. The curved section may be defined in a direction along the member (e.g. the direction may be defined between one end collar to the other end collar or parallel to an axis of the centraliser). The curved section may be defined in a direction across the member (e.g. the direction may be defined circumferentially around an axis of the centraliser, or may be considered perpendicular to the direction defined between the end collars). It will be appreciated that at least one feature or component of the centraliser may be curved in one or more than one direction.

The intermediate portion may comprise a curved section. The curved section may be defined in a direction across the member. The curved section may be defined in a direction along the member. The curved section may define a first radius of curvature, which may correspond to the direction across the member and/or the direction along the member. The curved section may be for providing the intermediate portion with relatively less flexibility than the end portions.

The end portions may comprise a non-curved section or curved section defining a second radius of curvature. The non-curved section or curved section defining a second radius of curvature may be defined in a direction across the member. The non-curved section or curved section defining a second radius of curvature may be defined in a direction along the member. The second radius of curvature may be greater than the first radius of curvature. The non-curved section or curved section defining a second radius of curvature may be for permitting movement of the intermediate portion between the radially outer and inner positions.

Providing end portions having a greater radius of curvature than the intermediate portion may provide a degree of flexibility for the end portions that is greater than the flexibility of the (smaller radius of curvature) intermediate portion.

The end portions may each comprise at least two connectors for connecting the respective end portion to the respective end collar. The connectors of each end portion may diverge from the intermediate portion. The connectors may be spaced apart at the end collars.

Spacing the connectors of each end portion apart may help to distribute an externally applied load more equally, e.g. circumferentially, around the end collar. If an external load is applied to the intermediate portion, which may in turn be transferred to the end portions, the load may be transferred to the connectors. By spacing the connectors of each end portion apart, the load on each connector may be reduced, which may reduce stress on each connector. Spacing the connectors apart may help to control bending, torsional, or any other forces on the end portions, which may otherwise distort the end portions to such an extent to prohibit or adversely affect recovery of the centraliser to the larger diameter configuration.

The connectors may define a forked or split connector for transferring force between the end portions and the end collars.

The connectors may comprise or define curved edges.

The space between the connectors may define an aperture, which may have curved edges. The aperture may define a tear-drop or triangular shape, which may have larger width proximal to the end collar and distal to the intermediate portion. The curved edges of the connectors may help to distribute load more evenly, e.g. to reduce or relieve stress on the connectors.

The end portion may comprise a curved section, which may be defined in a direction at least one of: across; and along the member. The curved section may be proximal to the respective end collar and distal to the intermediate portion. The curved section may be for providing the curved section with relatively less flexibility than another part of the end portions.

The end portions may each define a transition portion. The transition portion may be between a curved section of the intermediate portion and a curved section of the respective end collar. The transition portion may comprise a larger radius of curvature than at least one of: the curved section of the intermediate portion; and the curved section of the respective end collar.

The transition portion may comprise or define a flat, or relatively less curved, portion of the member, which may be relatively more flexible than at least one of: the intermediate portion and the end collar. The end collar and/or the intermediate portion may be less flexible than the transition portion. The transition portion may help to spread load or stress along the end portion, or at least soften the transition between the relatively less flexible components, so that load or stress may be less concentrated on the more flexible components.

If the end portion comprises a curved section for at least partially resisting flexing, twisting or deformation of the curved section of the end portion, the transition between the end collar (which may be relatively stiff) and the end portion (which may be relatively flexible) may be softened, which may help to spread load or stress along the end portion.

The curved section of end portion may be defined in a direction circumferentially around the centraliser.

The intermediate portion may comprise or define a curved or convex outer surface. The curved or convex outer surface may be defined in a direction along the members or may be defined between the end collars of the centraliser. The end portions may comprise or define a curved or concave outer surface, which may be defined in a direction along the members or may be defined in a direction between the end collars of the centraliser.

The transition portion of the end portions may comprise the concave outer surface.

The intermediate portion may comprise or define a curved or convex outer surface, which may be defined in a direction across the members or may be defined in a direction defined between adjacent members of the centraliser.

The members may comprise or define a convex outer surface along a length, for example, an entire length between the end collars. The members may comprise at least one of: a convex, flat or concave section along the length of the member. The members may comprise or define a convex outer surface along part of the length of the members and may comprise or define at least one of: a flat; and concave outer surface along another part of the length of the member.

The direction defined between adjacent members of the centraliser may define a circumferential direction with respect to the centraliser. The end collars may be coaxial with respect to an axis of the centraliser such that the circumferential direction may be defined in relation to the axis of the centraliser.

The end portions may comprise or define at least one of: a curved, convex, concave or flat outer surface in at least one of: a direction defined along; and across the member. The at least one of: the curved, convex, concave or flat outer surface may be defined in a direction defined between adjacent members of the centraliser and/or between the end collars of the centraliser.

In an initial, non-deformed condition or an at least partially-deformed condition, the centraliser may assume the larger diameter configuration, which may define a first radius of curvature. The centraliser may enter the bore in the initial non-deformed condition, and may subsequently be partially deformed to assume the partially-deformed configuration according to the diameter of the bore. The first radius of curvature may be defined by a radius of the bore. The curved or convex outer surface of the members may define a second radius of curvature, which may be defined in a direction across the members. The second radius of curvature may be equal to or less than the first radius of curvature such as at least in the non-deformed condition or an at least partially-deformed condition of the centraliser.

The curved or convex outer surface of the members may comprise a portion, for example a central portion or the like, that is contactable with the bore wall. The curved or convex outer surface of the members may comprise a portion, for example an edge portion or the like, that is not contactable with the bore wall in the non-deformed or partially deformed configurations. If the centraliser is deformed, in some circumstances, the edge portions may be in contactable with the bore wall. Providing edge portions, which may not be contactable with the bore wall, may reduce the friction between the members and the bore wall if moving the centraliser through the bore.

The first radius of curvature may correspond to a radius of curvature of the bore. By providing the second radius of curvature equal to or less than the first radius of curvature, the convex outer surface may have a reduced contact area between the intermediate portion and a bore wall. Reducing the contact area may reduce friction and/or ease passage of the centraliser through the bore.

The intermediate portion may comprise a ridge, rib, protrusion, or the like, which may reduce the contact area between the intermediate portion and the bore wall.

The centraliser may be configured to assume a different diameter depending on a degree of deformation of the members. The centraliser may comprise at least one support element for restricting flexing or deformation of the members. Restricting flexing or deformation of the members may prevent the centraliser assuming a diameter smaller than a threshold diameter, which may ensure an at least partial recovery of the centraliser to a diameter larger than the threshold diameter.

In an initial condition, the centraliser may describe at least the first diameter, which may correspond to, be larger than, or smaller than the larger diameter configuration. The centraliser may be reconfigurable to a deformed condition to describe a smaller second diameter to permit passage of the centraliser through a bore restriction. The centraliser may be reconfigurable to a recovered condition to describe the first diameter and centralise the tubing in the bore. In the deformed configuration, the degree of deformation of the members may be restricted to ensure recovery of the centraliser to the first diameter.

The second diameter may be equal to or more than the threshold diameter.

The at least one support element may be configurable to abut the tubing upon flexing or deformation of at least one of the members.

The at least one support element may be flexible or deformable.

The at least one support element may be configured to support at least one of: the intermediate portion and the end portions. The at least one support element may be configured to support a radially outermost part of the members.

The at least one support element may be configured to support a portion of the members comprising a mid-way point between the end collars.

The radially outermost part of the member may define a crest or high point of the members.

The members may each comprise a convex outer surface defined circumferentially around the centraliser.

The outer surface may comprise a contact surface of the members. The contact surface may be contactable with a wall of the bore. The convex outer surface may be defined at least partially along a length of the member. The convex outer surface may be defined at least partially across a width of the member. The length of the member may be defined as part of the member extending in an axial or downhole direction with respect to the centraliser in the bore. The width of the member may be defined as part of the member extending in a circumferential direction with respect to the centraliser in the bore. A thickness of the member may be defined in a radial direction with respect to the centraliser in the bore.

In an initial, non-deformed condition, the centraliser may describe a first diameter that defines a first radius of curvature. The convex outer surface of the members may each define a second radius of curvature. The second radius of curvature may be equal to or less than the first radius of curvature.

The first radius of curvature may be defined circumferentially around the bore. The second radius of curvature may be defined circumferentially around the centraliser. By providing the members with the second radius of curvature, there may be reduced friction between the centraliser and the bore when moving the centraliser through the bore. There may be reduced wearing of the members due to this reduced friction.

The members may comprise at least one end portion for connecting the members to the end collars of the centraliser. The members may comprise at least two end portions for connecting the member to an end collar of the centraliser.

The end portion may be bifurcated. Providing more than one end portion for each member end may help to evenly distribute force around the end collar.

The members may comprise at least two end portions for connecting each end of each member to their respective end collars, wherein the connections between each adjacent end portion on each end collar are equally spaced apart circumferentially around the end collar. It will however be appreciated that in an example, the adjacent connections may not be equally spaced apart circumferentially around the end collar. Depending on the particular geometry of the centraliser, it may or may not be possible to distribute the end portion connections equally spaced apart circumferentially around the end collar. For example, larger diameter centralisers or centralisers comprising more than four, five or six members may provide sufficient space for accommodating equally spaced apart end portion connections while smaller diameter centralisers or centralisers comprising less than four, five or six members may not provide sufficient space for accommodating equally spaced apart end portion connections.

By providing an equal distance as defined between the end portions, there may be an even distribution of force at least partially circumferentially around the end collars of the centraliser. In use, for example in a horizontal section of bore, the centraliser members on the lower side of the bore may experience a greater degree of deformation than those centraliser members on the upper side of the bore. The centraliser members on the lower side of the bore may exert a greater force on the end collars than the force exerted on the end collars by the members on the upper side of the bore. By providing end portion connections that are equally spaced apart circumferentially around the end collars, the force exerted on the end collars by the members may be more evenly distributed than in the case where the end portion connections are not equally spaced apart circumferentially around the end collars. This may reduce excessive stress or strain being applied to certain parts of the end collars, or indeed within any other part of the centraliser.

The at least one support element may comprise a concave outer surface. The outer surface of the support element may face a wall of the bore. The outer surface of the support element may not, in general, be contactable with the bore wall. The support element may comprise or have an arcuate form.

The support element may comprise a convex inner surface. The convex inner surface may face the casing, and may be moved to abut the casing e.g. in response to being passed through a bore restriction.

The at least one support element may extend from one end portion to another end portion of the members. The at least one support element may be arranged to apply a force between a first end and a second end of the members.

The at least one support element may be configured to apply a force on or resist a force applied by the members. The at least one support element may be configured to provide support at a mid-way point of the members. The mid-way point may be defined between the end collars. The at least one support element may be configured to provide support for the intermediate portion The at least one support element may be centred or symmetric about the mid-way point of the members.

The at least one support element may be configured to apply a force on or resist a force applied by the members. The at least one support element may be configured to provide support at a point along the members that is between a mid-way point and an end portion of the members.

The at least one support element may be positioned along the members so as to be located proximal to one end collar of the centraliser and distal to the other end collar of the centraliser.

The at least one support element may comprise at least one arcuate spring element. At least one support element may extend at least partially along a central portion of at least one of: the intermediate portion and the end portions. At least one support element may extend at least partially along a central portion of the members. At least one support element may extend at least partially along an edge of at least one of: the intermediate portion and the end portions. At least one support element may extend at least partially along an edge of the members.

The members may comprise or may be formed of a metal.

The centraliser may comprise at least one contact surface for contacting a wall of the bore. The contact surface may comprise a friction-reducing coating. The members may comprise the contact surface. The friction-reducing coating may form part of the members. The friction-reducing coating may comprise at least one of: polytetrafluoroethylene; and graphene.

Any other appropriate coating may be applied to the members to reduce the friction between the members and the bore wall, or the members may be formed with or modified to comprise the friction-reduction coating. The members may comprise a metal.

According to an example of the present disclosure there is provided a centraliser for centralising tubing in a bore. The centraliser may comprise end collars connected by members. The members may comprise an intermediate portion. The members may comprise end portions for connecting the intermediate portion to the end collars. The centraliser may be configurable between a larger diameter configuration and a smaller diameter configuration. The end portions may or may each comprise at least two connectors for connecting the respective end portion to the respective end collar. The connectors of each end portion may diverge from the intermediate portion so as to be spaced apart at the end collars.

Spacing the connectors of each end portion apart may help to distribute an externally applied load more equally, e.g. circumferentially, around the end collar. If an external load is applied to the intermediate portion, which may in turn be transferred to the end portions, the load may be transferred to the connectors. By spacing the connectors of each end portion apart, the load on each connector may be reduced, which may reduce stress on each connector. Spacing the connectors apart may help to control bending, torsional, or any other forces on the end portions, which may otherwise distort the end portions to such an extent to prohibit or adversely affect recovery of the centraliser to the larger diameter configuration.

The connectors may define a forked or split connector for transferring force between the end portions and the end collars.

In the larger diameter configuration, the intermediate portion may assume a radially outer position with respect to the centraliser. In the smaller diameter configuration, the intermediate portion may assume a radially inner position.

The centraliser may comprise at least one feature of the centraliser of any example of the present disclosure.

According to an example of the present disclosure there is provided a centraliser for centralising tubing in a bore. The centraliser may comprise end collars connected by members having a curved or convex outer surface. In an initial, non-deformed condition or an at least partially deformed condition, the centraliser may describe a first diameter that defines a first radius of curvature. The curved or convex outer surface of the members may define a second radius of curvature. The second radius of curvature may be defined in a direction across the members. The second radius of curvature may be equal to or less than the first radius of curvature, for example, at least if the centraliser is in the non-deformed condition or an at least partially deformed condition.

The convex outer surface may be defined in a direction or plane circumferentially around the centraliser. The first radius of curvature may be defined circumferentially around the bore. The second radius of curvature may be defined in a direction or plane circumferentially around the centraliser. By providing the members with the second radius of curvature, there may be reduced friction between the centraliser and the bore when moving the centraliser through the bore. There may be reduced wearing of the members due to this reduced friction.

The centraliser may comprise at least one feature of the centraliser of any example of the present disclosure. At least one feature of the present centraliser may comprise, replace or be combined with at least one feature of any centraliser of the present disclosure.

According to an example of the present disclosure there is provided a centraliser for centralising tubing in a bore. The centraliser may comprise end collars connected by members having a contact surface for contacting a wall of the bore. The contact surface may comprise a friction-reducing coating.

By providing the members with the friction-reducing coating, there may be reduced friction between the centraliser and the bore when moving the centraliser through the bore. There may be reduced wearing of the member due to the reduced friction.

The contact surface may comprise a friction-reducing coating forming part of the members. The friction-reducing coating may comprise at least one of: polytetrafluoroethylene; and graphene. The person of ordinary skill in the art will appreciate that other friction-reducing coatings may be provided.

The centraliser may comprise at least one feature of the centraliser of any example of the present disclosure. At least one feature of the present centraliser may comprise, replace or be combined with at least one feature of any centraliser of the present disclosure.

According to an example of the present disclosure there is provided a method of manufacturing a centraliser for centralising tubing in a bore. The centraliser may comprise end collars connected by members having a contact surface for contacting a bore wall. The method may comprise at least one of: coating; forming; and modifying at least part of the contact surface so as to comprise a friction-reducing coating.

The friction-reducing coating may comprise at least one of: polytetrafluoroethylene; and graphene. At least one of: polytetrafluoroethylene; and graphene may be able to reduce the wear rate and the coefficient of friction of the contact surface. The friction-reducing coating may be applied to the contact surface by dipping the surface into a solution comprising graphene. At least a partial coating of graphene may be very effective at reducing friction. The friction-reducing coating may be applied, coated, formed or used to modify the contact surface using any appropriate technique.

According to an example of the present disclosure there is provided a method of running tubing into a bore. The method may comprise providing a plurality of centralisers on a string of tubing. The centralisers may comprise end collars connected by members for permitting the centraliser to assume a different diameter depending on a degree of deformation of the members. The members may be restricted to prevent the centraliser assuming a diameter smaller than a threshold diameter. The method may comprise running the tubing and the centralisers through a bore restriction to radially deform the centralisers. The method may comprise running the tubing and the centralisers from the bore restriction into a bore section to ensure an at least partial recovery of the centralisers to a diameter larger than the threshold diameter.

The method may have particular utility in running tubing such as casing into inclined or horizontal bores, for example in bores for oil and/or gas wells, where the mass of the tubing will tend to compress or deform the centraliser members located between the tubing and the lower side of the bore. In the absence of restriction of the degree of deformation of the members, the members between the tubing and the low side of the bore will likely experience a greater degree of deformation than the members between the tubing and the high side of the bore and may experience excessive or non-recoverable deformation as the centralisers pass through the bore restriction. On the tubing passing into the bore section beyond the bore restriction, members that have experienced excessive deformation may not recover sufficiently to allow the centraliser to describe the first diameter and maintain the tubing coaxial with the bore.

With the present method the degree of deformation of individual members may be restricted to ensure that the members will recover sufficiently to maintain the tubing substantially coaxial with the bore. If the tubing and centralisers are being run through a horizontal tubing restriction there will be a tendency for the centraliser members between the tubing and the low side of the bore to experience a greater degree of deformation, however with the degree of deformation of individual members being restricted, the deformation is more likely to be more evenly distributed between the members.

The threshold diameter may define a minimum diameter of the centraliser, below which the members may experience excessive deformation to the extent that the excessively deformed members may not recover sufficiently to allow the centraliser to describe a larger target diameter upon moving into the bore section after the bore restriction. By restricting the members to prevent the centraliser assuming a diameter smaller than the threshold diameter, the centraliser may be capable of at least partially recovering to a larger diameter than the threshold diameter so as maintain the tubing substantially coaxial with the bore.

Those of skill in the art will recognise that with a deformable centraliser there will always be an inevitable degree of deformation of the members on the low side of the tubing in inclined or horizontal bores applications, and this is recognised by, for example, the American Petroleum Institute's Specification 10D for spring bow centralisers.

The centralisers may describe at least a first diameter in an initial condition. The method may comprise radially deforming the centralisers to describe a smaller second diameter defined by the bore restriction.

The centraliser may be in the initial condition before entering the bore. The diameter of the bore may define the first diameter. Upon entering the bore, the centralisers may be partially deformed to assume the first diameter.

The second diameter may be equal to or more than the threshold diameter. Upon being deformed in the bore restriction, the centralisers may not be deformed to a diameter less than the threshold diameter. By only deforming the centralisers to a diameter equal to or more than the threshold diameter, the centralisers may not experience excessive deformation.

Restricting the members to prevent the centraliser assuming a diameter smaller than a threshold diameter may comprise providing at least one support element between the members and the tubing.

The at least one support element may be arranged to prevent deformation of the members resulting in the centraliser describing a diameter below the threshold diameter.

The method may comprise restricting deformation of the members by abutting the at least one support element against the tubing in response to a radial compression of at least one of the members.

The method may comprise moving the centralisers through a bore restriction in an inclined or horizontal bore section. The method may comprise restricting members on a lower side of the centraliser from deforming excessively in response to a weight applied on the members by the tubing as the centraliser passes through the bore restriction.

Restricting members on the lower side of the centraliser from deforming may comprise supporting the tubing so that the tubing adopts a substantially coaxial position within at least one of: the bore restriction and the bore section.

Supporting the tubing may comprise providing at least one support element for maintaining the tubing in the substantially coaxial position. The at least one support element may resist deformation of the members on the lower side of the bore so as to maintain the tubing at a minimum radial distance above the lower sider of the bore. The minimum radial distance may be defined by the threshold diameter. The minimum radial distance may be defined by the diameter of the bore restriction. The minimum radial distance may be equal or approximately equal to half of the difference between the threshold or bore restriction diameter and the diameter of the tubing.

According to an example of the present disclosure there is provided a method of running tubing into a bore, the method comprising:

providing a plurality of centralisers on a string of tubing, the centralisers comprising end collars connected by members and describing at least a first diameter;

running the tubing and the centralisers through a bore restriction of a second diameter smaller than the first diameter whereby the centralisers are radially deformed to describe the smaller second diameter, with the degree of deformation of individual members being restricted to ensure recovery of the centralisers to the first diameter; and running the tubing and the centralisers from the bore restriction into a bore section of the first diameter whereby the centralisers recover to describe the first diameter.

According to another example of the present disclosure there is provided a centraliser for tubing to be run into a bore of a first diameter through a bore restriction of a smaller second diameter, the centraliser comprising end collars connected by members and in an initial condition the centraliser describing at least the first diameter, the centraliser being reconfigurable to a deformed condition to describe the smaller second diameter to permit passage through the bore restriction, and the centraliser being reconfigurable to a recovered condition to describe the first diameter and centralise the tubing in the first diameter bore, in the deformed configuration the degree of deformation of individual members being restricted to ensure recovery of the centraliser to the first diameter.

According to an example of the present disclosure there is provided a member for a centraliser for centralising tubing in a bore, the member being configured to connect end collars of the centraliser. The member may comprise at least one feature of any member of the present disclosure. The member may further comprise at least one support element comprising at least one feature of any support element of the present disclosure.

According to an example of the present disclosure there is provided a centraliser for centralising tubing in a bore. The centraliser may comprise end collars connected by members for permitting the centraliser to assume a different diameter depending on a degree of deformation of the members. The centraliser may comprise at least one support element for restricting deformation of the members to prevent the centraliser assuming a diameter smaller than a threshold diameter to ensure an at least partial recovery of the centraliser to a diameter larger than the threshold diameter.

At least one feature of any example, aspect or embodiment of the present disclosure may replace any corresponding feature of any example, aspect or embodiment of the present disclosure. At least one feature of any example, aspect or embodiment of the present disclosure may be combined with any other example, aspect or embodiment of the present disclosure.

BRIEF DESCRIPTION OF THE DRAWINGS

These and other examples of the disclosure will now be described by way of example only and with reference to the accompanying drawings, in which:

FIG. 3 is a side view of a centraliser in accordance with an example of the present disclosure;

FIG. 4*a* is an axial view of the centraliser of FIG. 3;

FIG. 4*b* is an expanded view of part of the centraliser of FIG. 4*a* schematically illustrated within a bore;

DETAILED DESCRIPTION OF THE DRAWINGS

Figure 1:
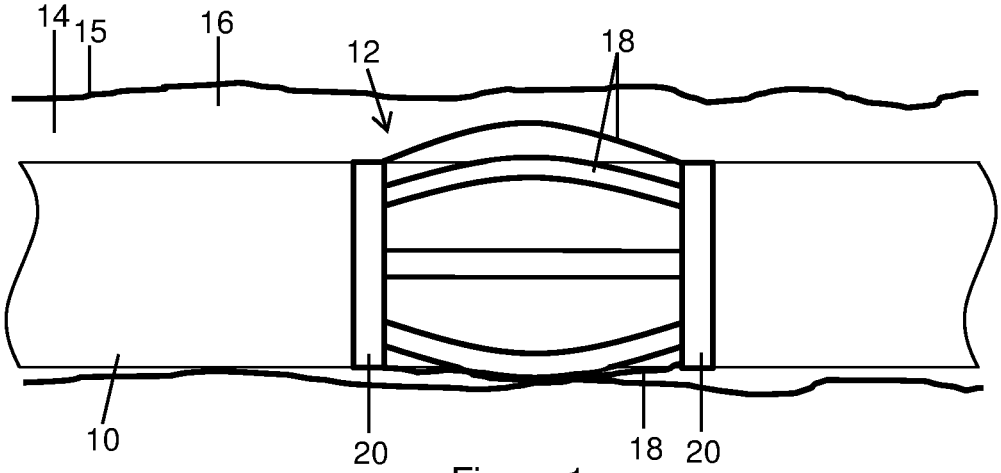
FIG. 1 is a schematic illustration of a casing in a non-central position in a horizontal section of a bore where a centraliser for supporting the casing has partially deformed e.g. due to the weight of the casing.

FIG. 1 illustrates a casing 10 supported by a centraliser 12 in a horizontal section of a drilled bore 14. An (asymmetric) annulus 16 is defined around the casing 10 and a wall 15 of the bore 14. Settable material such as cement is circulated between the bore wall 15 and the casing 10. The centraliser 12 in this example includes eight circumferentially spaced-apart members 18 extending between two axially spaced apart end collars 20 that are mounted on the casing 10. The weight applied onto the centraliser 12 by the casing 10 can be significant which sometimes results in the centraliser 12 deforming or collapsing such that the casing 10 is liable to move to a non-coaxial, lower, position in the bore 14. As illustrated by FIG. 1, one of the members 18 at a lower portion in the bore 14 has been flexed, radially compressed or deformed such that the spring bias in the member 18 is unable to maintain the casing 10 in a central or coaxial position within the bore 14. In such a situation, the settable material such as cement which is circulated between the casing 10 and the bore wall 15 is unlikely to be evenly (or symmetrically) distributed circumferentially around the casing 10.

Referring next to FIGS. 2-7, various views and parts of a centraliser 112 are illustrated. The reference signs for like or similar features of the centraliser 112 and associated features have been incremented by 100 compared with the centraliser 12.

Figure 2:
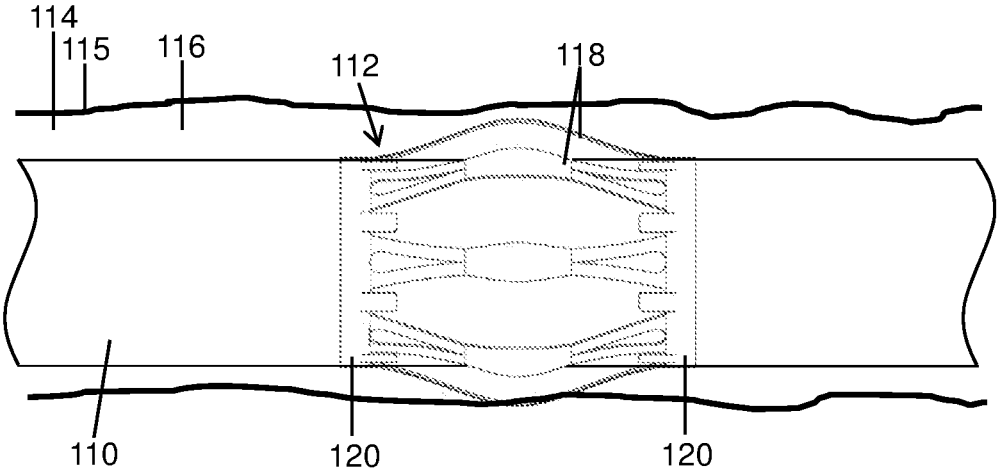
FIG. 2 is a schematic illustration of a casing supported in a central position in a horizontal section of a bore by a centraliser in accordance with an example of the present disclosure.

In contrast to FIG. 1, FIG. 2 illustrates a centraliser 112 that has not substantially deformed (or has at least partially recovered from a previous deformation) such that the casing 110 adopts a substantially central (e.g. coaxial) position within the bore 114. It will be appreciated that in all likelihood there will be a certain degree of deformation of any centraliser, particularly in horizontal sections of the bore where the weight of the casing is liable to cause deformation of the members on the lower side of the bore 114, which can be recognised with reference to both FIGS. 1 and 2. The substantially central position of the casing 110 illustrated by FIG. 2 may permit an approximately even distribution of settable material to be circulated through the annulus 116 defined between the casing 110 and the bore wall 115.

As the centraliser 112 is moved through the bore 114, at least one member 118 of the centraliser 112 may flex or deform in response to passing through restrictions in the bore 114 and may return, at least substantially, to their first or initial (e.g. a non-flexed, non-compressed or non-deformed) condition. Each member 118 includes an intermediate portion 119 and end portions 121 for connecting the intermediate portion 119 to the end collars 120. The centraliser 112 is configurable between a larger diameter configuration in which the intermediate portion 119 assumes a radially outer position with respect to the centraliser 112 and a smaller diameter configuration in which the intermediate portion 119 assumes a radially inner position (e.g. to permit passage of the centraliser 112 through a bore restriction). The end portions 121 are configured to permit movement of the intermediate portion 119 between the radially outer and inner positions. The intermediate portion 119 is relatively less flexible than the end portions 121. In this example, the intermediate portion 119 is relatively less flexible than the end portions 121 due to the intermediate portion 119 being relatively more curved (e.g. has a smaller radius of curvature) than the end portions 121.

Figure 5:
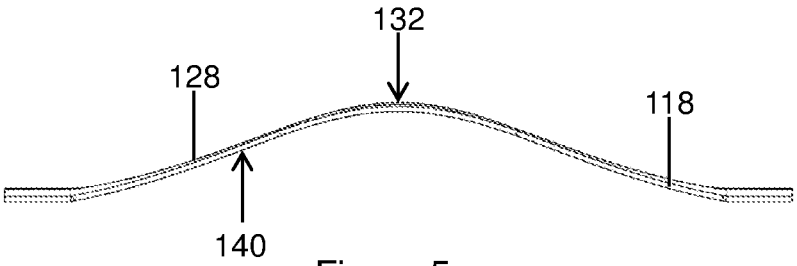
FIG. 5 is a side view of a member of the centraliser of FIG. 3.
Figure 6:
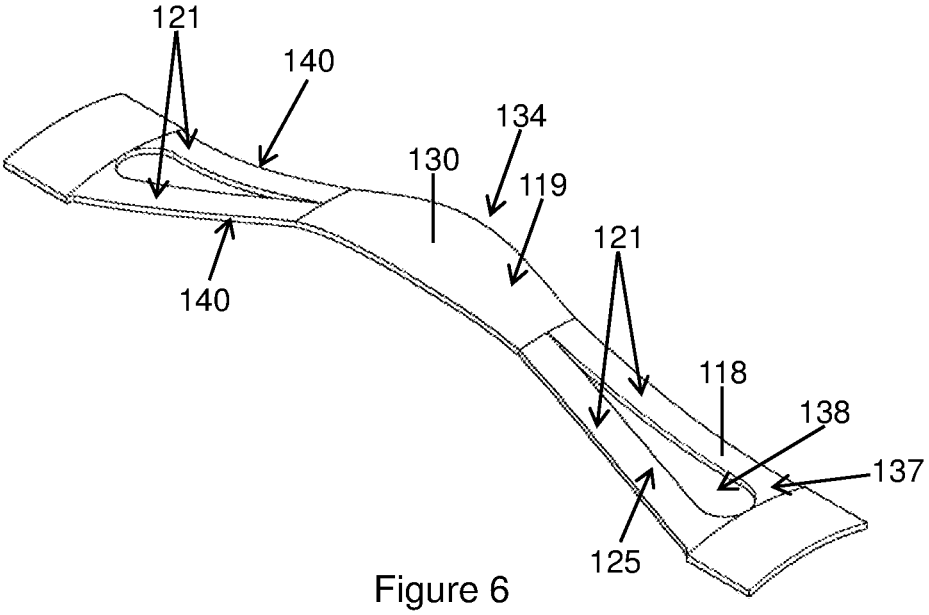
FIG. 6 is a perspective view of a member of the centraliser of FIG. 3.
Figure 7:
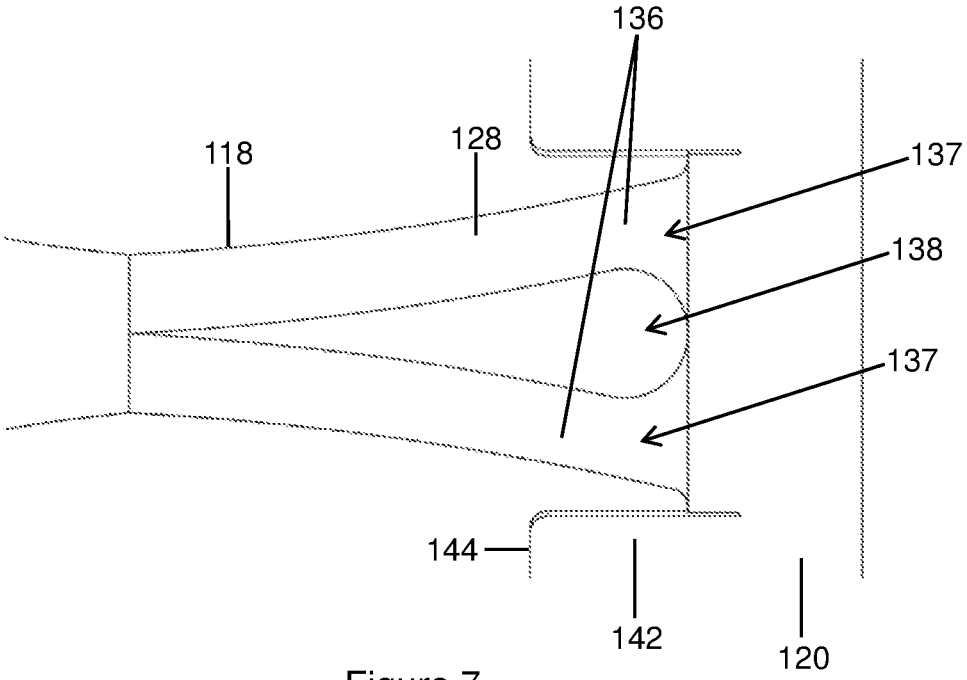
FIG. 7 is a partial side view of the centraliser of FIG. 3.
Figure 8:
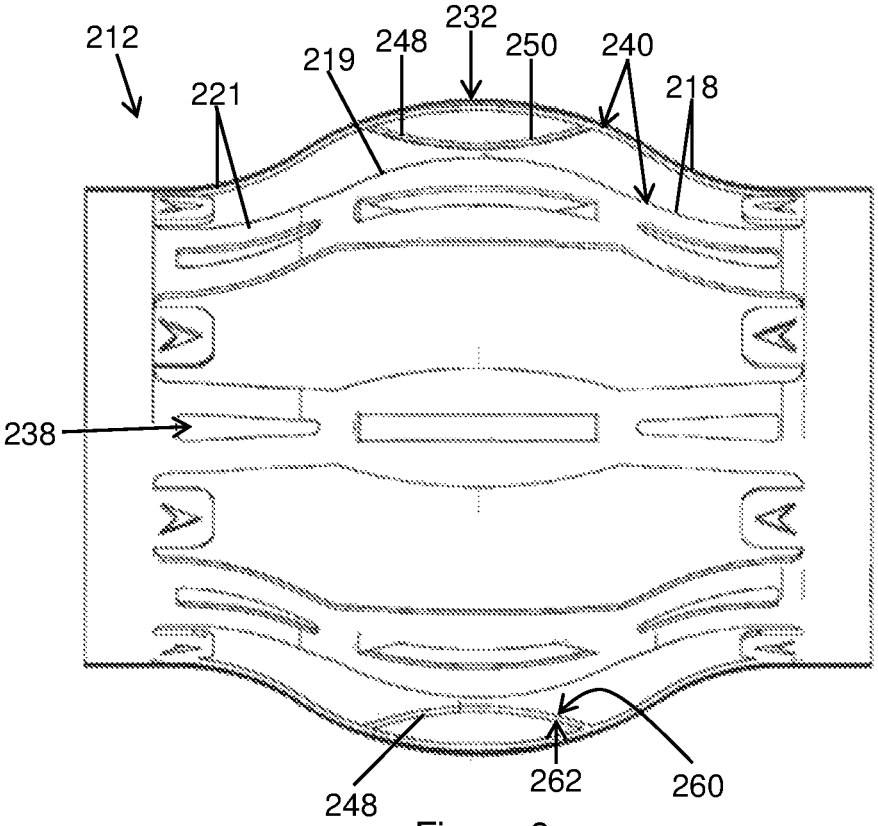
FIG. 8 is a side view of a centraliser in accordance with an example of the present disclosure.
Figure 9:
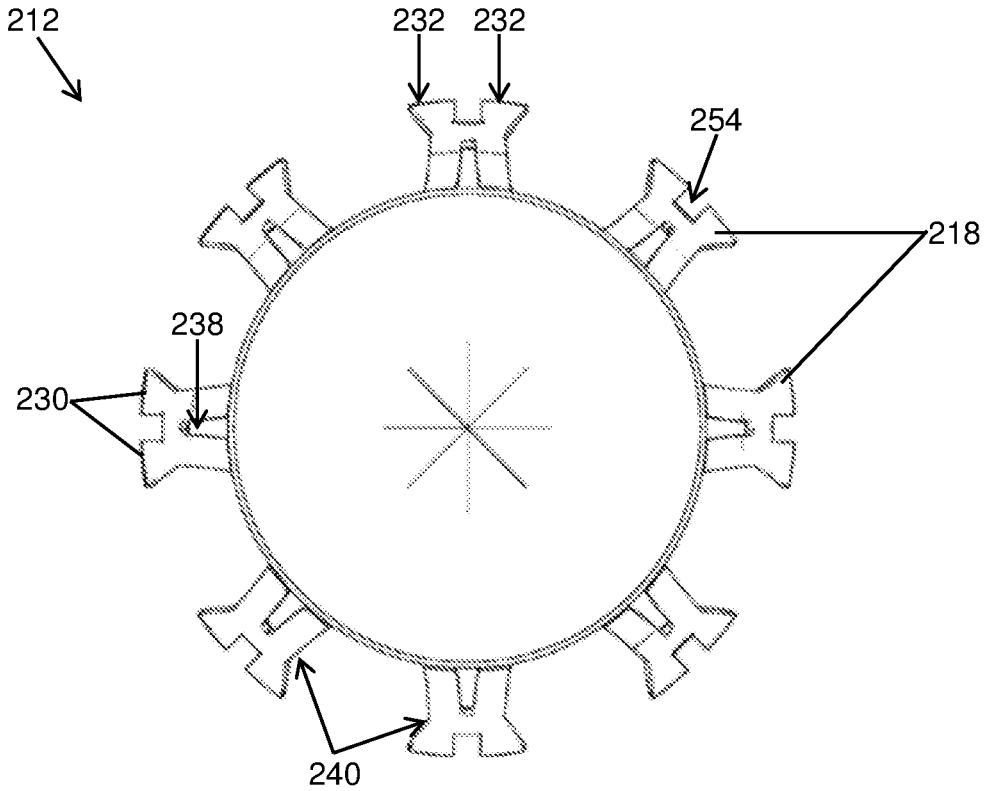
FIG. 9 is an axial view of the centraliser of FIG. 8.

Each member 118 has an outer surface 128 that is oriented to face the bore wall 115. The outer surface 128 includes a contact surface 130 for contacting the bore wall 115, the contact surface 130 extending at least partially along the outer surface 128 and includes a crest 132 of the member 118. As best illustrated by FIG. 5, the crest 132 defines a high (or radially outermost) point of the member 118 and is located at a mid-portion 134 between the two collars 120. With reference to at least FIGS. 5 and 6, the intermediate portion 119 includes a convex outer surface 128 defined in a direction along the member 118 and the end portions 121 include a concave outer surface 128 also defined in the direction along the member 118. It will be appreciated that there may be a flat surface defined between the convex and concave outer surfaces of the member 118.

The intermediate portion 119 includes a curved section 123 defining a first radius of curvature (e.g. in a direction defined between adjacent members 118 or across the members 118) for providing the intermediate portion 119 with relatively less flexibility than the end portions 121. In this example, the end portions 121 include a non-curved section 125 provided along a length of the end portion 121 for permitting movement of the intermediate portion 119 between the radially outer and inner positions. The non-curved section 125 is relatively more flexible than the curved sections (e.g. of the intermediate portion 119).

The end portions 121 each include two connectors 136 for connecting the respective end portion 121 to the respective end collar 120. The connectors 136 of each end portion 121 diverge from the intermediate portion 119 so as to be spaced apart at the end collars 120.

The two connectors 136 of each end portion 121 each include a curved section 137 proximal to the respective end collar 120 and distal to the intermediate portion 119 for providing the curved section 137 with relatively less flexibility than another part of the end portions 121 (such as the non-curved section 125).

The non-curved section 125 at least partially defines a transition portion between the intermediate portion 119 and the respective end collar 120. The intermediate portion 119 includes a convex outer surface and the end portions 121 include a concave outer surface defined in a direction between the end collars 120 of the centraliser 112. The intermediate portion 119 also defines a convex outer surface in a direction defined between adjacent members 118 of the centraliser 112. The end portions 121 include both a convex (e.g. at least the curved section 137) and a flat outer surface (e.g. the non-curved section 125) in a direction defined between adjacent members 118 of the centraliser 120.

A teardrop-shaped aperture 138 is defined between the connectors 136 and the end collar 120. Each member 118 includes edges 140 extending along the length of the member 118. The edges 140 include arcuate sections, including parts having a convex or concave form. The curved form of at least one part of the members 118 provides a degree of stiffness, or less flexibility, than at least one other part of the members 118.

As best illustrated by FIG. 4*b*, the bore wall 115 defines a first radius of curvature (e.g. circumferentially around the bore 114). The contact surface 130 of the member 118 defines a second radius of curvature (e.g. circumferentially around the centraliser 112 or across the member 118), the second radius of curvature in this case being less than the first radius of curvature. The outer surface 128 (including the contact surface 130) of the member 118 is convex when viewed in an axial or downhole direction (as best illustrated by FIGS. 4*a-b*). The radius of curvature of the contact surface 130 being less than the radius of curvature of the bore wall 115 may reduce friction between the member 118 and the bore wall 115 as the centraliser 112 moves through the bore 114 (i.e. compared to a member having a contact surface that has a radius of curvature that is more than the radius of curvature of the bore wall 115, e.g. if the contact surface of such a member is flat (or non-curved) when viewed in the axial or downhole direction). The contact surface 130 includes a central portion 154 that is contactable with the bore wall 115 and edge portions 155 that are not contactable with the bore wall 115 if the centraliser is in a non-deformed or partially-deformed condition, which may reduce friction as the centraliser 112 moves through the bore 114. The member 118 may experience less drag, wearing or deformation during passage through the bore 114 due to this reduced friction property.

Optionally, the contact surface 130 includes a friction-reducing coating such as polytetrafluoroethylene (e.g. Teflon™), graphene, or the like, e.g. for easing the movement of the centraliser 112 through the bore 114.

The end collars 120 each include eight casing engagement elements 142 for axially restricting the range of movement of the centraliser 112 on the casing 110. The casing engagement elements 142 are in the form of axially extending protrusions 144 disposed between each of the members 118 and extending from each collar 120 and facing towards corresponding casing engagement elements 142 on the other collar 120. The casing engagement elements 142 are configured to engage a stop collar (not shown) mounted on the casing 110 so as to permit a limited degree axial movement of the centraliser 112 along the casing 110 but to prevent the centraliser 112 from slipping substantially along the casing 110 during movement of the casing 110 through the bore 114. Thus, the centraliser 112 is partially free to move relative to the casing 110 but will not significantly deviate from the position defined by the stop collar.

Referring next to FIGS. 8-11, various views and parts of a centraliser 212 are illustrated. The reference signs for like or similar features of the centraliser 212 and associated features have been incremented by 100 compared with the centraliser 112. The following description highlights the features which are different to those features already described in relation to FIGS. 2-7.

The centraliser 212 of FIGS. 8-11 has generally a similar form to the centraliser 112 of FIGS. 2-7. The centraliser 212 includes members 218 for contacting the bore wall 115. The members 218 are radially moveable or deformable between the casing 110 and the bore wall 115 from an initial, non-deformed, condition into a deformed condition to permit movement of the centraliser 212 through restrictions in the bore 114.

The members 218 have edges 240 including a convex and concave form that extends along the members 218. With reference to e.g. FIG. 8, it will be recognised that some of the edges 240 include straight edges as well as curved edges. The member 218 includes apertures 238 (similar to the apertures 138 of members 118) which are in the form of a rounded-corner triangle.

However, each of the members 218 also include a support element 248 for restricting deformation of the elements 218 (e.g. which may occur when the centraliser 212 passes through restrictions in the bore 114 and/or in response to weight applied on the centraliser 212 by the casing 110).

The support element 248 is in the form of an arcuate spring element 250 that extends substantially across a portion (e.g. from one end portion 221 to the other end portion 221) of each of the members 218. The support element 248 is partially cut out from a central portion 254 defined within an intermediate portion 219 of each of the members 218 and extends from extends from the first end portion 221 to the second end portion 221 of the members 218. The first end portion 221 is provided between the aperture 238 at one end of the member 218 and the crest 232 of the member 218. The second end portion 221 is provided between the aperture 238 at the other end of the member 218 and the crest 232. The first end portion 221 and second end portion 221 each define a transition which joins the member 218 to both ends of the support element 248. Accordingly, each member 218 includes two contact surfaces 230 extending along (and radially outwardly of) the support element 248.

Radial compression of the member 218 may result in an inner surface 260 of the support element 248 abutting the casing 110. Upon abutting the casing 110, the support element 248 may resist further radial compression of at least one of the members 218. The support element 248 restricts deformation of the corresponding member 218 to prevent the centraliser 212 assuming a diameter smaller than a threshold diameter to ensure an at least partial recovery of the centraliser 212 to a diameter larger than the threshold diameter. If the centraliser 212 is deformed to assume a diameter that is less than the threshold diameter, the members 218 may have been excessively deformed to the extent that the centraliser 212 may not sufficiently recover to its initial, non-deformed, condition (e.g. after passing through a restriction in the bore 114). The support element 248 is symmetric about the crest 232 and is arranged to restrict deformation of the members 218 in response to a radial compression of the members 218.

Figure 10:
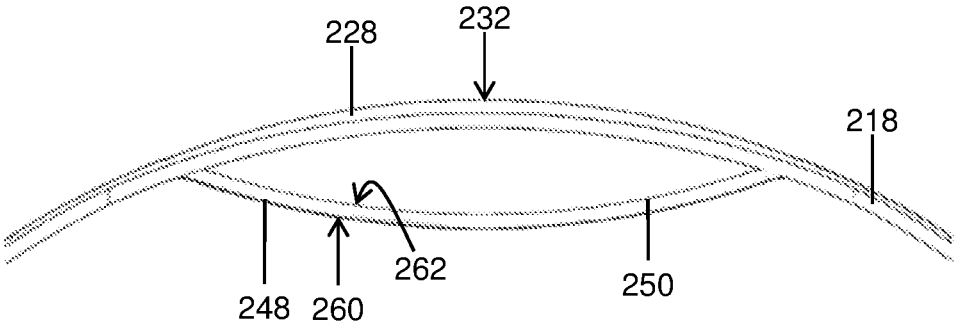
FIG. 10 is a partial side view of a member of the centraliser of FIG. 8.
Figure 11:
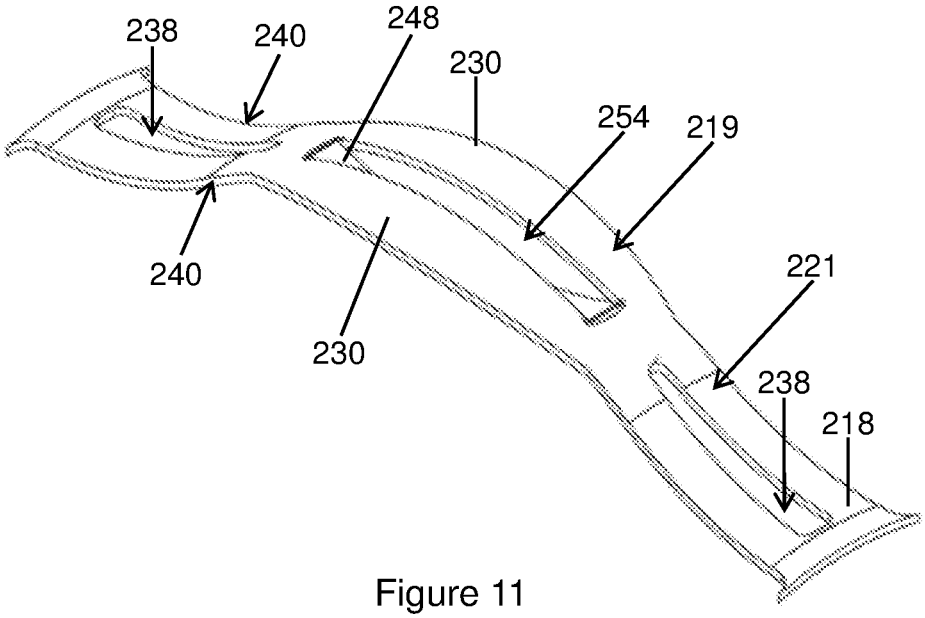
FIG. 11 is a perspective view of a member of the centraliser of FIG. 8.

As best illustrated by FIG. 10, the member 218 includes a convex outer surface 228 when viewed from the side. In contrast, the support element 248 includes a concave outer surface 262 (correspondingly, the inner surface 260 is convex). Thus, the member 218 is curved radially outwardly so as to be contactable with the bore wall 115 whereas the support element 248 is curved radially inwardly and is not generally contactable with the bore wall 115.

Figure 12:
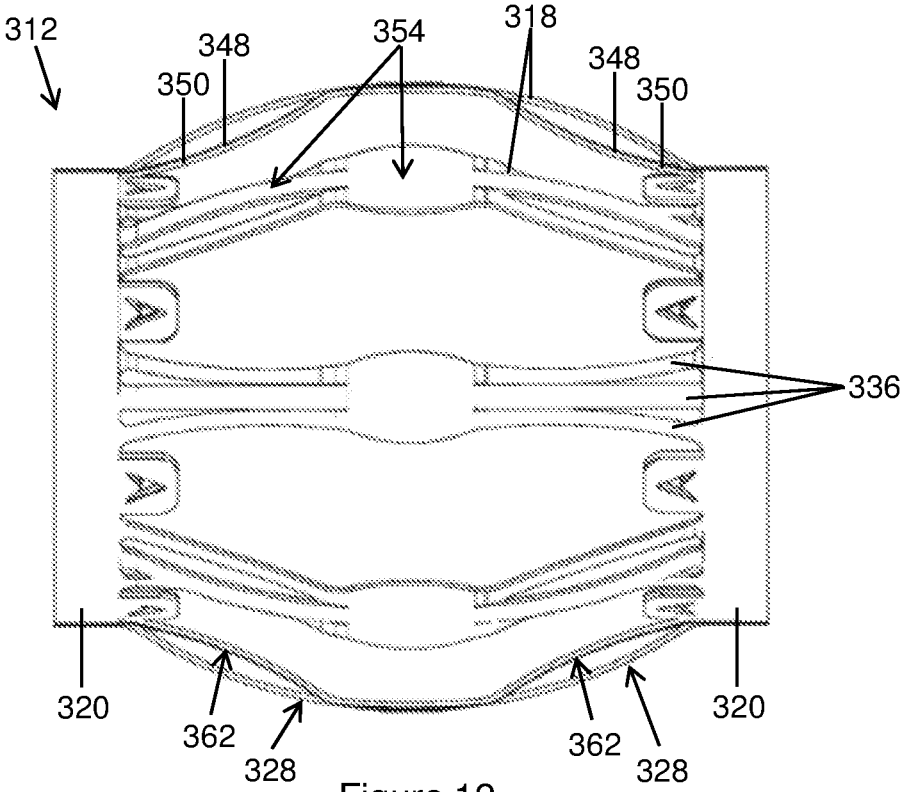
FIG. 12 is a side view of a centraliser in accordance with an example of the present disclosure.
Figure 13:
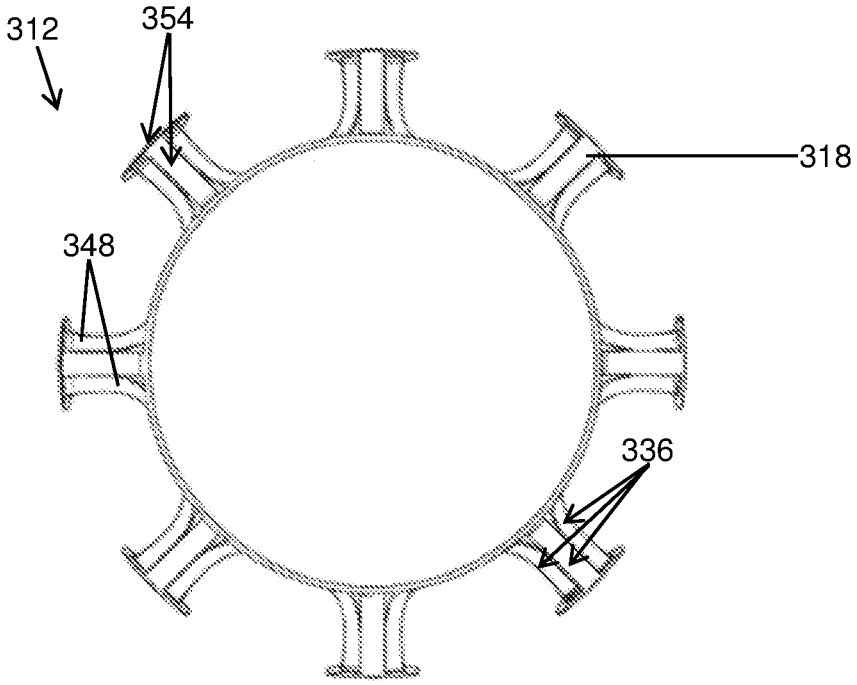
FIG. 13 is an axial view of the centraliser of FIG. 12.
Figure 14:
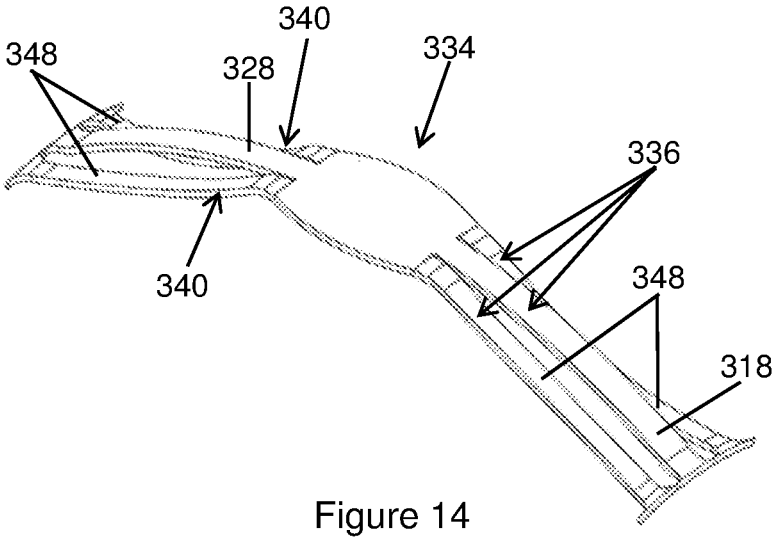
FIG. 14 is a perspective view of a member of the centraliser of FIG. 12.

Referring next to FIGS. 12-14, various views and parts of a centraliser 312 are illustrated. The reference signs for like or similar features of the centraliser 312 and associated features have been incremented by 100 compared with the centraliser 212. The following description highlights the features which are different to those features already described in relation to FIG. 2-7 or 8-11.

The centraliser 312 of FIGS. 12-14 has generally a similar form to the centraliser 212 of FIGS. 8-11. The members 318 each include four support elements 348, each of which has similar functionality to the members 218 and support element 248 of FIGS. 8-11. However, the arrangement of the members 318 and support elements 348 is different in this example.

The members 318 include an outer surface 328 and extend between the two end collars 320, including a central portion 354 extending along a length of the member 318 between the two end collars 320.

The support elements 348 in this example include a number of arcuate spring elements 350 (in this example four in total per member 318). Two of the arcuate spring elements 350 extend between one of the end collars 320 and a mid-way point 334 along the member 318. Each of the arcuate spring elements 350 extend at least partially along an edge 340 of the member 318. The two arcuate spring elements 350 at each end of the member 318 are spaced apart from each other with the part of the member 318 extending between the collars 320 being disposed between the two spaced apart arcuate spring elements 350.

The members 318 are arcuate and include a convex outer surface 328 substantially along their entire length between the end collars 320. The arcuate spring elements 350 include a concave outer surface 362 substantially along their entire length between their respective collars 320 and the mid-way point 334. An identical (or symmetric) arrangement is provided for the other two arcuate spring elements 350 for joining the other collar 320. In contrast to previous examples, the members 318 are connected to each collar 320 using three connectors 336 instead of two connectors. The arcuate spring elements 350 include two of the three connectors 336 (at each end of the member 318) for connecting the arcuate spring elements 350 to the end collar 320.

The member 318 includes the other of the three connectors 336 (at each end of the member 318).

The arcuate spring elements 350 are positioned so as to apply a reaction force that acts to ensure that the mid-way point 334 of the members 318 defines a radially outermost part of the members 318. The arcuate spring elements 350 are configured to abut the casing 110 in response to a radial compression of the members 318 similar to the example of FIGS. 8-11 but in contrast to the example of FIGS. 8-11 in which the arcuate spring element 250 are deformable for abutting the casing 110 at a mid-way point 234 between the end collars, the arcuate spring members 350 in the present example are deformable for abutting the casing 110 either side of the mid-way point 334. Two of the arcuate spring elements 350 extend along the member 318 so as to be located proximal to a first end collar 320 of the centraliser 312 and distal to a second end collar 320 of the centraliser 312. Equally, the other two arcuate spring elements 350 are positioned in an equivalent way in relation to the second end collar 320 but proximal thereto.

Figure 15:
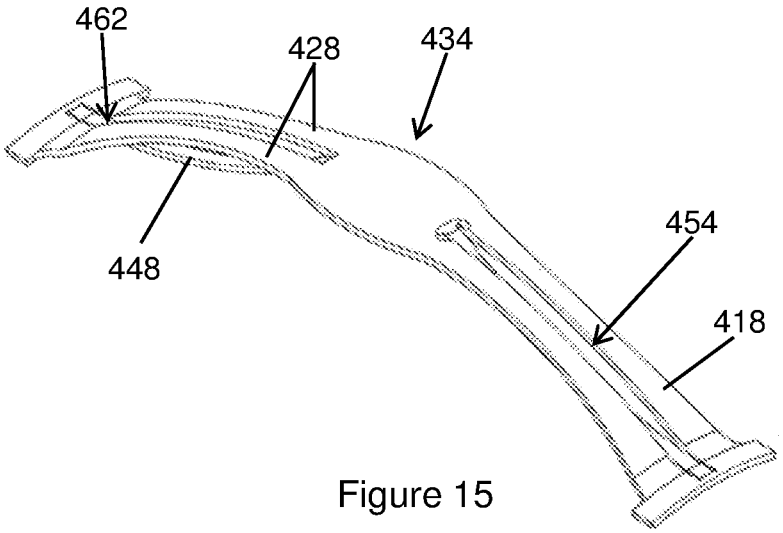
FIG. 15 is a perspective view of another example of a member.
Figure 16:
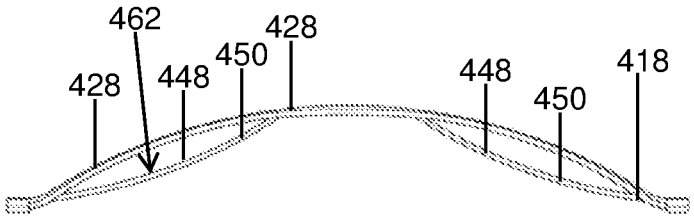
FIG. 16 is a side view of the member of FIG. 15.

Referring next to FIGS. 15-16, there is illustrated an example of a member 418 suitable for a centraliser. The reference signs for like or similar features of the member 418 and associated features have been incremented by 100 compared with the member 318. The following description highlights features that are different to those features already described in relation to FIGS. 12-14.

The member 418 has a number of similarities to the member 318. However, the member 418 has a number of features which can be considered to be inverted compared to the member 318.

The member 418 is arcuate and includes a convex outer surface 428 substantially along its entire length. However, in contrast to the previous example where the four arcuate spring elements 350 defined the support elements 348 of the member 318, the corresponding components in this example are now inverted so as to form part of the member 418 and now include the convex outer surface 428 instead of a concave outer surface.

Further, in contrast to the previous example where parts of the member 318 extend between the spaced-apart arcuate spring elements 350 and the end collars 320, these parts are now inverted so as to form the support element 448 and now each include a concave outer surface 462. Thus, these two parts now take the form of arcuate spring elements 450. Therefore, in this example, two support elements 448 are defined, each support element 448 extending between a respective collar (e.g. similar to collar 320) and a mid-way point 434 along the member 418. The support elements also extend at least partially along a central portion 454 of the members 418.

Various modifications may be made to any of the disclosed examples. At least one feature of one example may replace, be combined with or used to modify at least one feature of another example.

Although some of the examples illustrate members which are integral with the collars (e.g. to form one-piece components), it will be appreciated that the members and/or centraliser can be constructed in any appropriate way. For example, the members could be provided as separate components and then connected to the collars (e.g. by welding, or the like). At least one example of a centraliser of the present disclosure may be formed as a one-piece component, for example, by laser cutting or the like a single-piece of material which can be formed into the one-piece centraliser. It will be appreciated that the members and end collars may be provided as separate components and subsequently connected together in any appropriate way. The intermediate and end portions may be provided as separate components and subsequently joined together. The centraliser may be at least partially constructed or formed using an additive or reductive manufacturing process, which may be performed in any appropriate way.

Although some of the examples illustrate centralisers having eight members, it will be appreciated that any appropriate number of members may be provided.

The invention claimed is:

1. A centraliser for centralising tubing in a bore, comprising:

end collars connected by members, wherein the members are integral with the collars, the members and the collars forming a one-piece construction, wherein the members comprise an intermediate portion and end portions for connecting the intermediate portion to the end collars, wherein the centraliser is configurable between a larger diameter configuration in which the intermediate portion assumes a radially outer position with respect to the centraliser and a smaller diameter configuration in which the intermediate portion assumes a radially inner position, wherein the end portions are configured to permit movement of the intermediate portion between the radially outer and inner positions, and the intermediate portion is relatively less flexible than the end portions, wherein the intermediate portion comprises a curved section, defined in a direction along the members, defining a first radius of curvature, the intermediate portion defining a convex outer surface, and wherein the end portions comprise a curved section, defined in the direction along the members, defining a second radius of curvature, the second radius of curvature being greater than the first radius of curvature defined by the intermediate portion, the end portions defining a concave outer surface.

2. The centraliser of claim 1, wherein the end portions each comprise at least two connectors for connecting the respective end portion to the respective end collar, the connectors of each end portion diverging from the intermediate portion so as to be spaced apart at the end collars.

3. The centraliser of claim 2, wherein the connectors comprise or define curved edges.

4. The centraliser of claim 1, wherein the end portions comprise a curved section, defined in a direction across the member, wherein the curved section defined in the direction across the member is proximal to the respective end collar and distal to the intermediate portion and provides the curved section with relatively less flexibility than another part of the end portions.

5. The centraliser of claim 1, wherein the intermediate portion comprises or defines a curved or convex outer surface in a direction defined across the members or defined between adjacent members of the centraliser.

6. The centraliser of claim 1, comprising at least one support element for restricting flexing or deformation of the members, to prevent the centraliser assuming a diameter smaller than a threshold diameter and to ensure at least partial recovery of the centraliser to a diameter larger than the threshold diameter.

7. The centraliser of claim 6, wherein at least one of:

the at least one support element is configurable to abut the tubing upon flexing or deformation of at least one of the members;

the at least one support element is configured to support at least one of the intermediate portion and the end portions; and the at least one support element is configured to apply a force on or resist a force applied by the members.

8. The centraliser of claim 6, wherein the at least one support element comprises a concave outer surface.

9. The centraliser of claim 6, wherein the at least one support element extends from one end portion or one of the end collars to the intermediate portion.

10. The centraliser of claim 6, wherein the at least one support element is positioned along the members so as to be located proximal to one end collar of the centraliser and distal to the other end collar of the centraliser.

11. The centraliser of claim 6, wherein the at least one support element comprises at least one arcuate spring element.

12. The centraliser of claim 6, wherein the at least one support element extends at least partially along a central portion of at least one of:

the intermediate portion and the end portions.

13. The centraliser of claim 6, wherein the at least one support element extends at least partially along an edge of at least one of: the intermediate portion and the end portions.

14. The centraliser of claim 1, wherein the members comprise or are formed of a metal.

15. The centraliser of claim 1, comprising at least one contact surface for contacting a wall of the bore, the contact surface comprising a friction-reducing coating.

16. The centraliser of claim 2, wherein the connectors define a forked or split connector for transferred force between the end portions and the end collars.

17. The centraliser of claim 16, wherein the space between the connectors defines an aperture.

18. The centraliser of claim 17, wherein the aperture defines a teardrop or triangular shape.

19. The centraliser of claim 1, wherein the end portions each define a transition portion between a curved section of the intermediate portion and a curved section of the respective end collar, the transition portion comprising a larger radius of curvature than at least one of: the curved section of the intermediate portion; and a curved section of the respective end collar.

20. The centraliser of claim 1, wherein the end portions comprise or define at least one of: a curved, convex, concave or flat outer surface in a direction defined across the member.

21. The centraliser of claim 1, wherein the at least one support element is flexible or deformable.

22. The centraliser of claim 6, wherein the at least one support element is configured to apply a force on or resist a force applied by the members, wherein the at least one support element is configured to provide support for the intermediate portion, and wherein the at least one support element is centred or symmetric about the intermediate portion.

23. The centraliser of claim 15, wherein the friction-reducing coating comprises at least one of polytetrafluoroethylene and graphene.

* * * * *